US005103884A

United States Patent [19]

Roman

[11] Patent Number: 5,103,884

[45] **Date of Patent: * Apr. 14, 1992**

[54] WALLET WITH REMOVABLE CLIP

[76] Inventor: D. Garry Roman, 1250 LaVenta #211, Westlake Village, Calif. 91361

[ * ] Notice: The portion of the term of this patent subsequent to Feb. 27, 2007 has been disclaimed.

[21] Appl. No.: 474,280

[22] Filed: Feb. 2, 1990

Related U.S. Application Data

[62] Division of Ser. No. 99,563, Sep. 22, 1987, Pat. No. 4,903,745.

[51] Int. Cl.[5] ..... A45C 1/06; A45C 13/18

[52] U.S. Cl. ..... 150/134; 150/137; 224/230; 224/240; 224/252; 224/269

[58] Field of Search ..... 150/131-134, 150/137, 147-149; 224/240, 252, 269, 230; D3/56, 60, 106; D11/78.1; 24/3 R, 3 S, 3 C, 67.9; 206/39

[56] References Cited

U.S. PATENT DOCUMENTS

| | | | |
|---|---|---|---|
| D. 138,396 | 8/1944 | Lambert et al. | D11/78.1 |
| D. 155,927 | 11/1949 | Rothkrug | D11/78.1 |
| D. 159,706 | 8/1950 | Wilcox | D11/78.1 |
| 2,697,861 | 12/1954 | Shively | 150/134 X |
| 3,147,896 | 9/1964 | Kehl | 150/134 X |
| 3,220,452 | 11/1965 | Mintzes et al. | 150/134 |
| 3,596,757 | 8/1971 | Cocchiaraley | 150/137 X |
| 3,854,639 | 12/1974 | Genchi | 224/252 X |
| 4,148,422 | 4/1979 | Habler | 224/252 X |
| 4,424,924 | 6/1984 | Perkins | 224/252 |
| 4,626,457 | 12/1986 | Willie | 150/137 |
| 4,667,374 | 5/1987 | Bianchi | 224/252 X |
| 4,705,086 | 11/1987 | O'Neill | 150/134 |
| 4,784,199 | 11/1988 | Wise | 150/134 |
| 4,903,745 | 2/1990 | Roman | 150/134 |

OTHER PUBLICATIONS

"Wonder Wallet" of California, 9/8/87.

*Primary Examiner*—Sue A. Weaver
*Attorney, Agent, or Firm*—David O'Reilly

[57] ABSTRACT

A wallet having a removable clip for use in a concealed fashion or for carrying in the pocket in a normal fashion. A pocket formed by a slot in the exterior surface of the wallet is provided for receiving a metal clip which can be easily detached. The clip when inserted in the pocket allows the wallet to be out of sight carried in the waistband of clothing, and is easily retrieved for access to the contents.

7 Claims, 4 Drawing Sheets

WALLET WITH REMOVABLE CLIP

CROSS-REFERENCE TO RELATED APPLICATION

This application is a division of application Ser. No. 07/099,563 filed Sept. 22, 1987, now U.S. Pat. No. 4,903,745.

FIELD OF THE INVENTION

This invention relates to wallets, money belts or other containers for carrying personal articles and money, and more particularly relates to a wallet having a removable clip which can be carried in a concealed position, or can be carried normally.

BACKGROUND OF THE INVENTION

A number of devices are available for carrying money and personal articles concealed. Among these devices are money belts which can be worn around the waste underneath clothing. Other devices include a wallet having a permanently attached clip which can be secured to the belt or waistband of clothing. There are also devices which can be strapped to the leg, or secured inside jackets and other clothing.

All of these devices, while effective, have disadvantages. For example, money belts which are worn around the waist, are inconvenient because often when traveling and shopping one has to retreat to a private area to retrieve money or valuables from the money belt because it is underneath the clothing. In any case, all these devices are specialized and are generally disfavored because they cannot be used normally to carry personal articles and money. They have special attachments or special shapes which permit them to only be used in a concealed manner. They may not be converted for use in a normal fashion, such as carrying in a hip pocket as one would normally carry a wallet. It would be advantageous if these devices could be easily used in this manner but the belts, clips, and other devices attached to them make them unsuitable for this purpose. For that reason most users will have two wallets, purses or pouches and will transfer their personal belongings to and from the concealed wallet to the normal wallet. Of course, this is a disadvantage to the user requiring the expense of two devices as well as the inconvenience of transferring all valuables from one wallet to another frequently. Having to remember which to use and when, is a further disadvantage.

It is therefore one object of the present invention to provide a wallet, or pouch, which can be carried in a concealed manner but can be easily converted for normal use.

Yet another object of the present invention is to provide a wallet, or device for carrying money and other valuables which has a removable clip which can be used in a normal fashion as a money clip, but also can be used to attach to the wallet to carry it in a concealed fashion.

Still another object of the present invention is to provide a unique wallet having a removable clip which is small and compact for carrying money and credit cards which and is easily accessible without removal from the clipped position.

BRIEF DESCRIPTION OF THE INVENTION

The purpose of the present invention is to provide a wallet or device for carrying money and other personal articles which can be easily carried in a concealed position, but then can be converted for carrying normally in a pocket.

These purposes are achieved by providing the normal container, such as a wallet, oriented vertically or horizontally having a removable clip. An advantage of this device is that it can be carried in a concealed manner on the waistband of clothing, but also can be carried in a pocket by removing the clip. The clip is constructed so that it can be used as a money clip when it is not clipped to the wallet. Thus, the wallet and clip serve the dual purpose of providing a concealed carrier for valuables, but also providing a money clip for carrying money in the pocket while the wallet is used in the normal fashion.

In an alternate embodiment of the invention the removable clip is oriented longitudinally on a compact wallet which can be clipped to the belt or waistband with access to the wallet easily provided by lifting a flap on the wallet. Money, coins or credit cards can be easily removed without removing the clipped wallet from the waistband or belt.

The above and other novel features and advantages of this invention will be fully understood from the following detailed description and the accompanying drawings, in which:

DETAILED DESCRIPTION OF THE INVENTION

Figure 1:
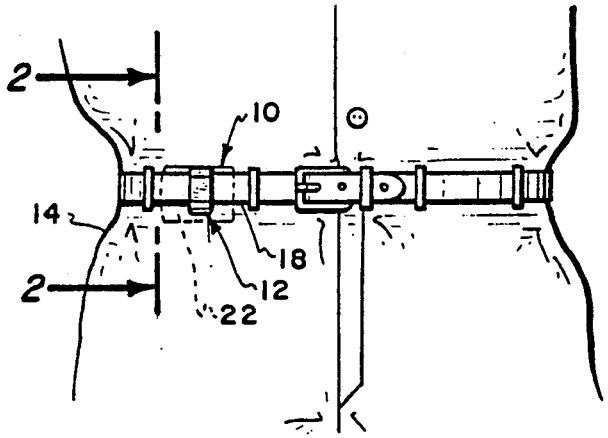
FIG. 1 illustrates a wallet constructed according to the invention carried in a concealed fashion in the waistband of clothing.

Referring to FIG. 1 a wallet 10 is shown having a clip 12 for wearing the wallet concealed in the waistband of clothing, such as pants or skirt 14. The clip 12 is shown worn over a belt 18 but preferably would be beneath the belt to conceal as much as possible clip 12 and wallet 10. The manner of using and wearing the wallet 10 with clip 12 makes it easy to retrieve valuables from the wallet for use, but keeps the wallet substantially concealed to prevent theft.

Figure 2:
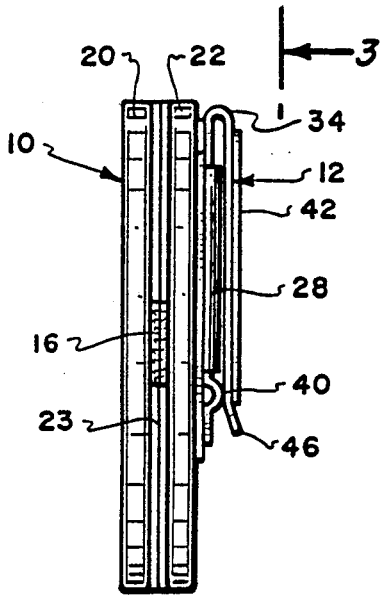
FIG. 2 is a view of the wallet of FIG. 1 taken at 2—2 of FIG. 1.
Figure 3:
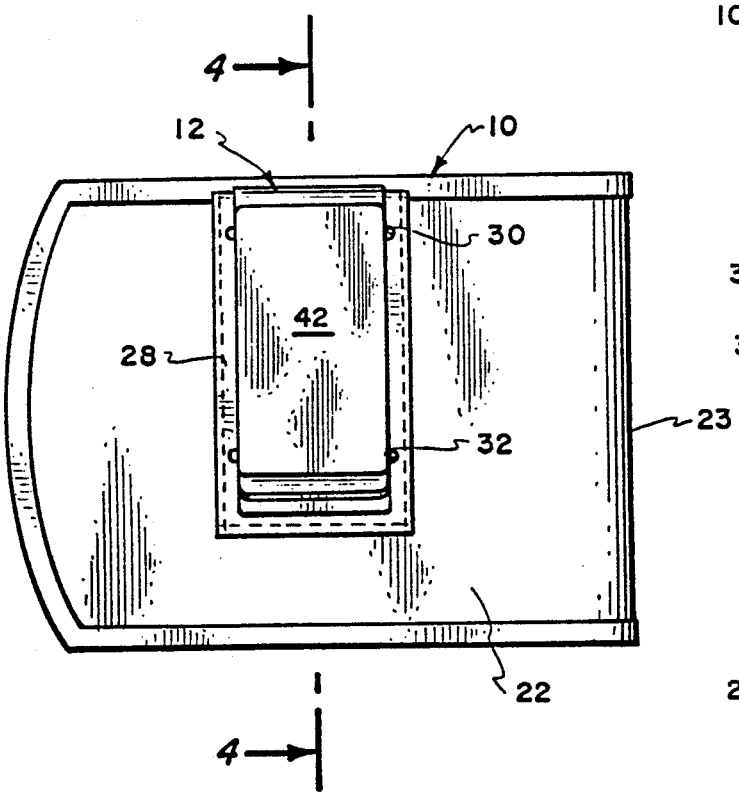
FIG. 3 is a view of the wallet construction taken at 3—3 of FIG. 2.
Figure 4:
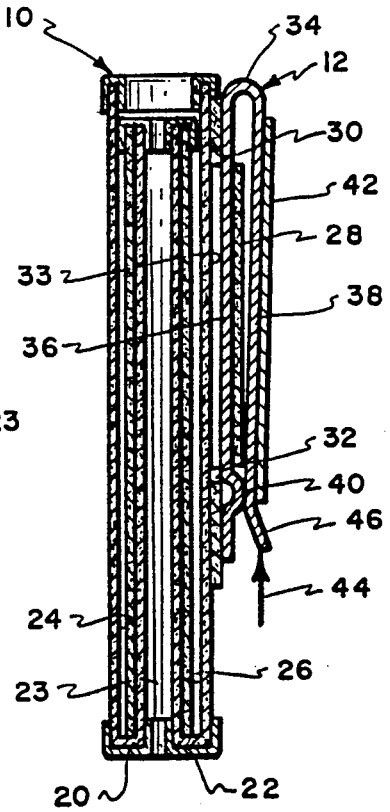
FIG. 4 is a sectional view taken at 4—4 of FIG. 3.

The wallet and clip construction is shown generally in FIGS. 2 through 4. The wallet 10 may be constructed of leather or synthetic material, such as vinyl, and is comprised of folded over flaps 20 and 22 in the usual manner forming hinge 23 and having pockets 24 and 26 for carrying money or other valuable articles, such as credit cards. Velcro strips 16 hold the wallet in a closed position. The interior design of the wallet can be any convenient construction to provide pockets for credit cards, money or other valuables but preferably has minimum pockets to keep it as thin as possible, while allowing a sufficient storage area to carry all the valuable articles needed.

The unique aspect of the wallet 10 and clip 12 is the removability of the clip to use the wallet in a normal fashion, such as carrying it in a pocket. Clip 12 is attached to the wallet by means of a patch 28 secured to the outside surface 22 of the wallet with an adhesive or sewing and having slots 30 and 32 at each end of pocket 33.

Clip 12 is a folded strip of spring steel or other suitable metal similar to the type used for a money clip. The metal strip is folded and bent at 34 forming a backplate 36 approximately the same length as frontplate 38. The backplate has a dimpled rib 40 mating with the backside of frontplate 38 securely clamping the clip 12 to the wallet 10. Clip 12 is attached to the wallet by inserting backplate 36 into pocket 33 through slots 30 and 32 until dimpled rib 40 is completely inserted. Upper plate 38 of clip 12 has a heavy metal plate 42 securely attached by adhesive or tack welding to provide an attractive monogram or logo plate if desired.

Clip 12 may be conveniently removed from wallet 10 by an upward push as indicated at arrow 44 on the end of bent flange 46 slightly rolled to provide a convenient gripping surface for fingers. When removed clip 10 can then be used as a money clip in a normal fashion, and the wallet can be conveniently carried in a pants or coat pocket as usual.

To use the wallet in a concealed manner as illustrated in FIG. 1 clip 12 is reinserted in pocket 33 by slipping backplate 36 through slots 30 and 32. Thus, the wallet 10 and money clip 12 may be used together or separately as desired providing a unique advantage of not requiring valuables to be transferred from the wallet to another container, when one wants to carry them in a concealed fashion.

An alternate embodiment of the wallet is shown in FIGS. 5 through 10 providing a more compact construction which allows carrying a minimum amount of valuables with access provided without removing the wallet from the clipped position, if desired. This particular embodiment can be carried concealed on the waistband or exposed on the waistband as illustrated on FIG. 5 for easy access. In this Figure wallet 50 is shown being carried in an exposed position at the waist with clip 52 engaging waistband of clothing 54 or on belt 56. Wallet 50 is shown in an exposed fashion for purpose of illustration, but may be carried in a concealed manner as wallet 10 in FIG. 1 is.

The compact mini-wallet is shown in detail in FIGS. 6 through 10. Wallet 50 is comprised of a flap 58 vertically oriented and a front flap 60 shorter in length than flap 58. Flaps 58 and 60 are joined at 62 forming a flexible hinge to open the compact wallet for access to pockets on the inside. Clip 52 is securely attached to compact wallet 50 by a patch of material 64 securely attached to flap 58 by sewing, adhesive or some other suitable means. Slots 66 and 68 in patch 64 provide a pocket 65 for receiving clip 52. A less desirable but alternate construction would be to provide slot 66 and 68 directly in the surface of flap 58 as will be disclosed in greater detail hereinafter. This also, of course, would apply to the previous wallet 10 in which the slots 30 and 32 could be simply provided in the surface of the wallet, but is less desirable because removal and replacement of the clips might tend to tear the material ruining the wallet. With the construction shown, the patch of material forming the slots or socket for receiving the clip could be easily removed and replaced if desired.

The clip 52 in this wallet is unique in construction because it is a triple-fold band of metal having bends at 70 and 72 forming frontplate 74, middleplate 76 and backplate 78. Backplate 78 has a dimpled rib 80 providing a bight against middleplate 76 to help retain the clip in the pocket 65 formed by slot 66 and 68. The tri-fold clip is advantageous because it minimizes the possibility of being dislodged from pocket 65. An inadvertent upward force on clip 52 would only serve to further seat backplate 78 in pocket 65. Clip 52 also includes a plate 82 on which a logo or monogram can be easily engraved to provide an attractive appearance. The plate 82 also acts as a stiffener for the clip.

Figure 9:
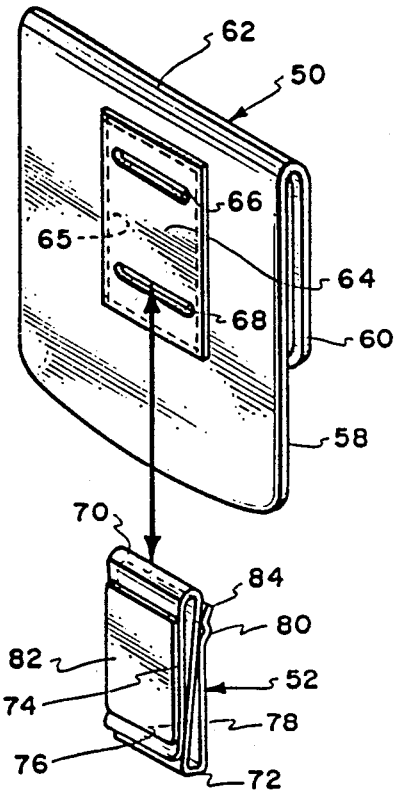
FIG. 9 is a perspective view illustrating the easy clip removal for separate use of the clip and wallet.

The mounting and removal of the clip is illustrated in FIG. 9. Clip 52 is mounted in pocket 65 by inserting end 84 or backplate 78 in slot 68 and pushing upwards on bend 72 of the clip until the bight formed by rib 80 passes completely through slot 66. The clip is thus securely retained in pocket 65 on compact wallet 50. To remove the clip for use of the wallet in a normal fashion a downward force on bend 70 will retract backplate 78 from pocket 69 allowing the clip to be used as a money clip.

Figure 10:
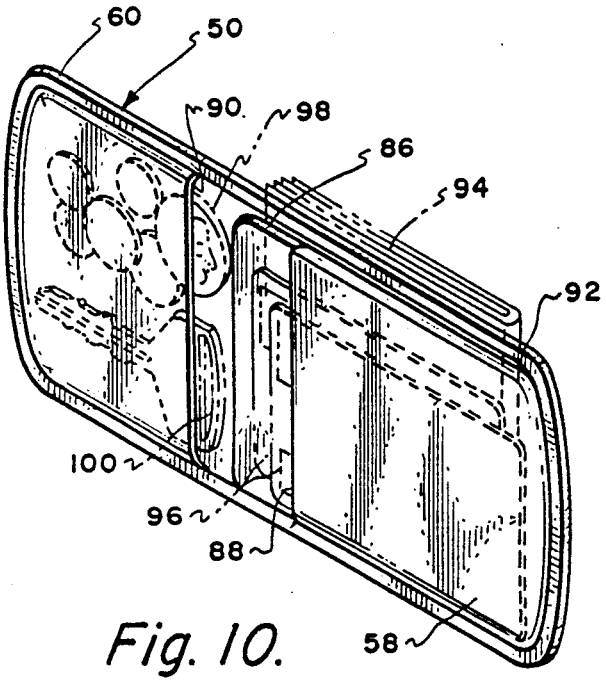
FIG. 10 is a perspective view illustrating storage of valuable articles and money in the compact wallet embodiment of FIGS. 5 through 8.

The construction and arrangement of compact wallet 50 is illustrated in FIG. 10. The interior of flaps 58 and 60 are comprised of a pockets 86 and 88 in flap 58 and a small pocket 90 in flap 60. Pocket 86 is opened along edge 92 for receiving folding money or papers 94. Pocket 88 is for insertion of credit cards 96 or the like. Coins and keys 98 and 100 respectively can be easily carried and removed from pocket 90.

Figure 5:
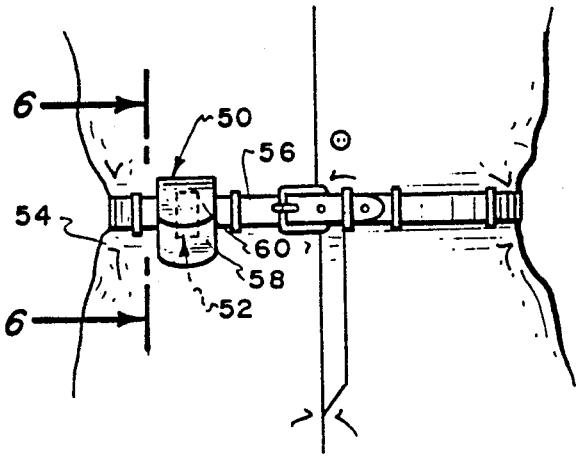
FIG. 5 is an illustration of the method of carrying an alternate embodiment of the invention in the belt or waistband.
Figure 6:
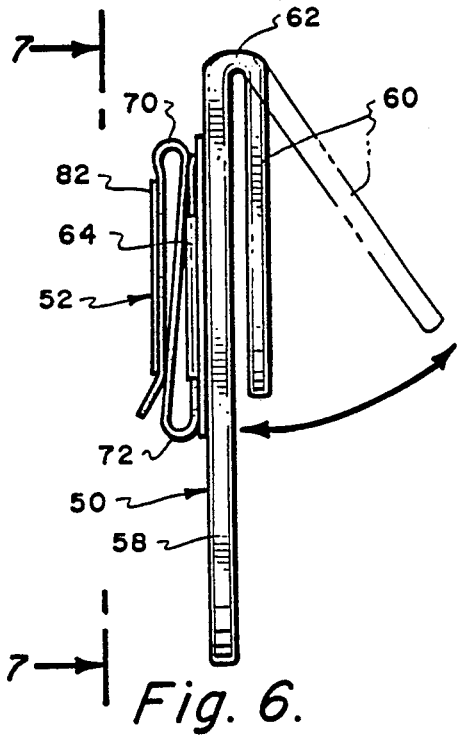
FIG. 6 is a view taken at 6—6 of FIG. 5 of an alternate compact wallet construction.
Figure 7:
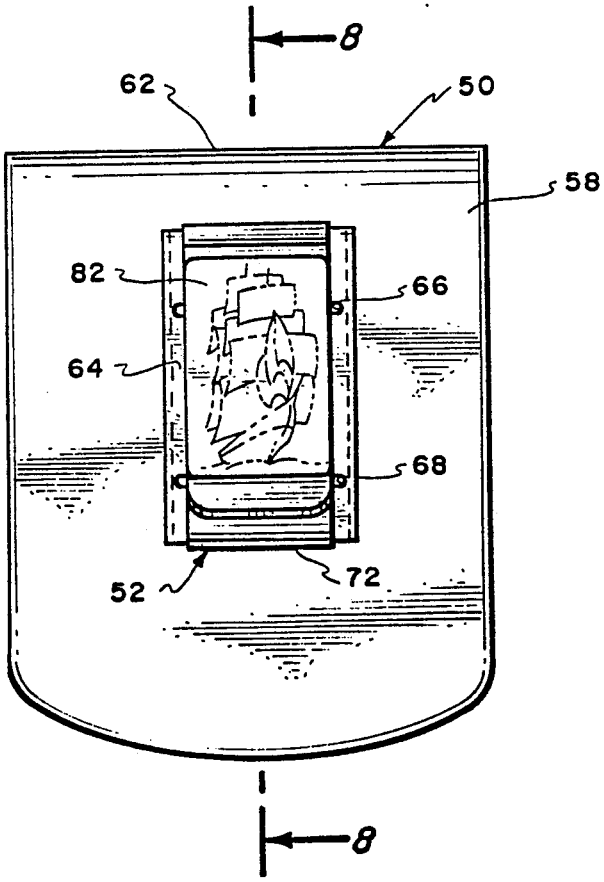
FIG. 7 is a view taken at 7—7 of FIG. 6.

When being worn, as shown in FIG. 5, easy access to the contents are provided by simply lifting flap 60 which will allow the coins or key to be easily removed from pocket 90 and also provide easy access to credit cards 96 and folding money 94 without removing the wallet from a clipped position. The compact construction allows the wallet to be easily carried in a pocket, on a belt, or inside of the waistband in a concealed fashion.

Figure 11:
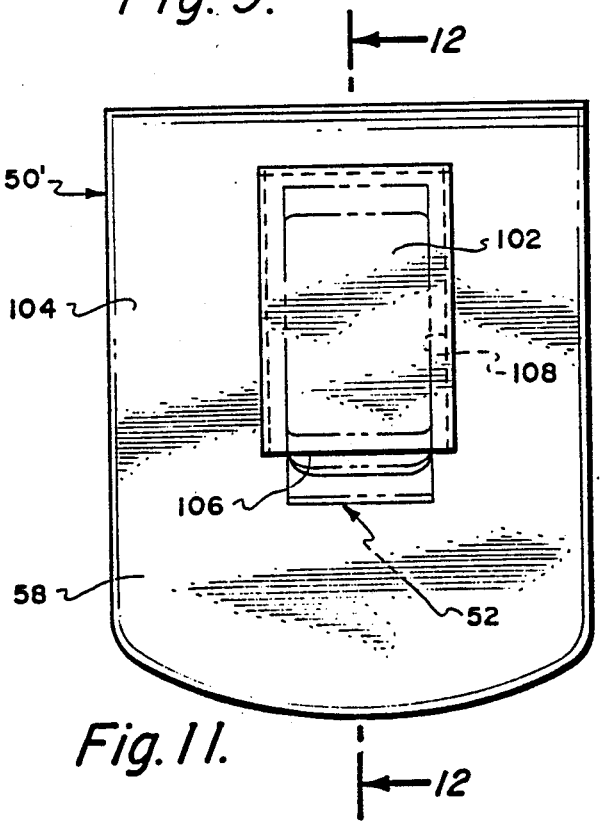
FIG. 11 illustrates an alternate construction for the clip holder.
Figure 12:
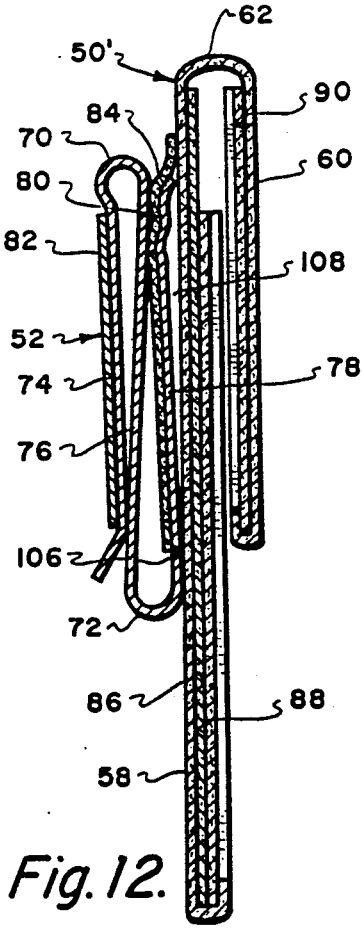
FIG. 12 is a view taken at 12—12 of FIG. 11.

An alternate construction for the clip holder is shown in FIGS. 11 and 12. In FIG. 11 the clip has been removed to show a clip holder or patch of material 102 on wallet 50' which is the same as in the embodiment of FIGS. 2 through 4. The patch of material 102 is secured to the surface 104 of wallet 50' along the top and sides and is left open along bottom edge 106 to form a pocket 108 as shown in FIG. 12. This construction facilitates insertion and removal of clip 52.

To install the clip 52 the end 84 is slipped into the open end 106 of pocket 108 and backplate is fully inserted by an upward push on bend 72. Clip 52 is just as easily removed by a downward force on bend 70. Installation and removal is quite easy, and less difficult than trying to thread clip backplate 78 through slots 66 and 68. The latter construction is some what more secure and might be preferable where the clip is only infrequently removed.

Figure 8:
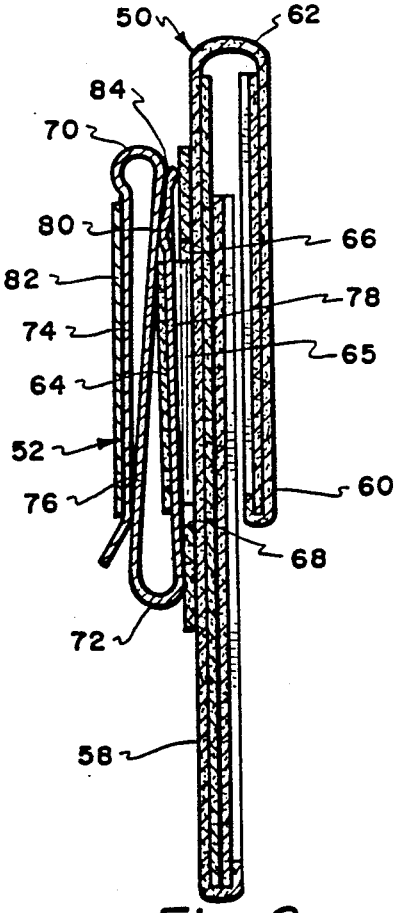
FIG. 8 is a sectional view taken at 8—8 of FIG. 7.
Figure 13:
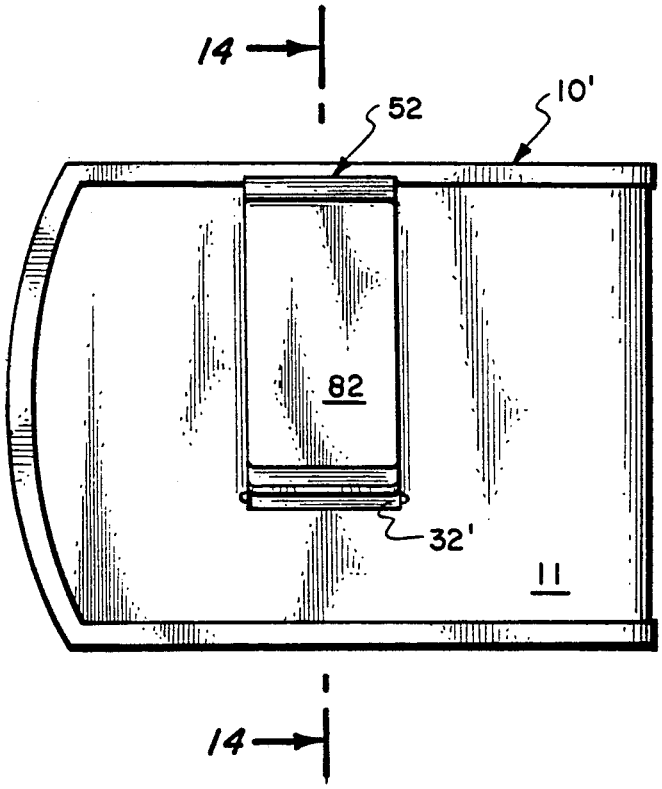
FIG. 13 is a view of an alternate wallet construction.
Figure 14:
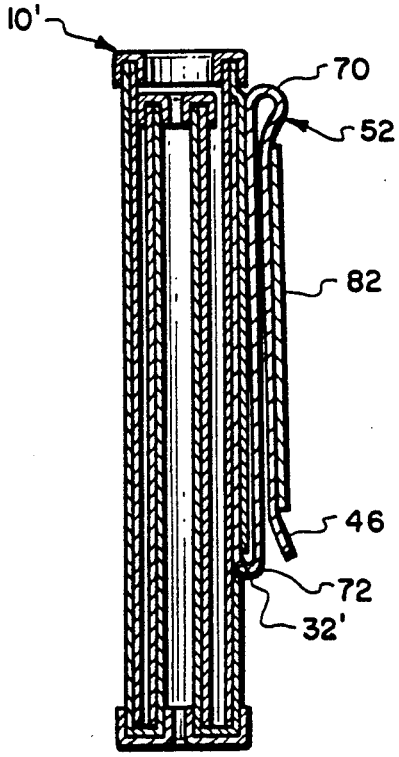
FIG. 14 is a sectional view taken at 14—14 of FIG. 13.

The further alternate construction of the invention previously described is shown in FIGS. 13 and 14. Here, wallet 10' is shown the same as in FIG. 3, but could be the smaller wallet of FIG. 6. Clip 52 is the same three part triple-fold clip shown in FIG. 8. However, instead of the mounting slots being in a separate patch of material attached to the surface of the wallet, a slot 32' is provided in the surface 11 of the material forming the wallet. Of course, an additional slot could be provided at the upper end of the pocket formed by slot 32, as shown in the embodiment of FIG. 3, if desired. This would allow the clip to be mounted, as shown in FIG. 8, with clip 52 extending out through the second upper slot and held more securely.

This invention is not to be limited by the embodiment shown in the drawings and described in the description which is given by way of example and not of limitation, but only in accordance with the scope of the appended claims.

What is claimed is:

1. In a wallet for carrying valuables having a plurality of compartments on first and second flaps joined by a pliable section allowing said wallet to be folded in half the improvement comprising;

pocket means formed by at least one slot in an exterior surface of one of said two flaps;

an S-shaped money clip formed of a metal plate folded twice to form three legs having a pair of bights at the end of each leg of said S-shaped money clip;

one leg of said S-shaped money clip constructed to removably fit into said pocket means on the exterior of said one flap;

whereby said wallet with said money clip inserted in said pocket means may be worn on the waistband of pants and concealed, or said money clip may be removed for using said wallet and money clip separately.

2. The wallet according to claim 1 in which said at least one slot forming said pocket means comprises a pair of parallel slots in the exterior surface forming said pocket means for receiving said one leg of said S-shaped money clip.

3. The wallet according to claim 2 in which said S-shaped money clip comprises a strip of metal bent to form three legs of substantially equal length.

4. The wallet according to claim 3 including a heavy metal plate secured to the exterior of one of said legs to stiffen said clip and provide a decorative surface.

5. The wallet according to claim 1 including a heavy metal plate secured to the exterior of one of said legs to stiffen said clip and provide a decorative surface.

6. The wallet according to claim 1 in which one of said flaps is approximately half the length of the other; said pocket means being oriented longitudinally on the exterior of the longer flap, whereby said wallet may be carried in a vertical orientation with said one shorter flap facing outward for easy access without unclipping said wallet from clothing.

7. The wallet according to claim 6 in which said at least one slot forming said pocket means comprises a pair of parallel slots in the exterior surface forming said pocket means open at both ends for receiving said one leg of said S-shaped clip.

* * * * *